US012349819B1

(12) United States Patent
Glick-Cuenot et al.

(10) Patent No.: US 12,349,819 B1
(45) Date of Patent: Jul. 8, 2025

(54) DRINKING TUBE INSERTION DEVICE

(71) Applicants: Sheri L. Glick-Cuenot, Delray Beach, FL (US); Kevin T. Cuenot, Delray Beach, FL (US)

(72) Inventors: Sheri L. Glick-Cuenot, Delray Beach, FL (US); Kevin T. Cuenot, Delray Beach, FL (US)

( * ) Notice: Subject to any disclaimer, the term of this patent is extended or adjusted under 35 U.S.C. 154(b) by 1 day.

(21) Appl. No.: 18/480,123

(22) Filed: Oct. 3, 2023

Related U.S. Application Data

(60) Provisional application No. 63/412,624, filed on Oct. 3, 2022.

(51) Int. Cl.
*A47G 19/22* (2006.01)

(52) U.S. Cl.
CPC ..... *A47G 19/2222* (2013.01); *A47G 19/2266* (2013.01)

(58) Field of Classification Search
CPC ..... A47G 19/2266; A47G 19/2222; A47G 19/2205; A47G 21/189; A47G 21/186; A47G 21/18; B65D 25/48; B05C 17/00506; B05C 17/00513
USPC ..... 215/391, 390, 388, 387; 220/709, 707, 220/705; 222/568, 567, 566
See application file for complete search history.

(56) References Cited

U.S. PATENT DOCUMENTS 2,438,024 A * 3/1948 Stransky ..... B65D 47/06 215/390
2022/0331834 A1* 10/2022 Springhorn ..... B05C 17/00503

* cited by examiner

*Primary Examiner* — Robert J Hicks
(74) *Attorney, Agent, or Firm* — Kevin T. Cuenot

(57) ABSTRACT

A device can include a tapping element. The tapping element is threaded and includes a channel having an entry aperture and an exit aperture. The tapping element includes a point configured to pierce a container top. The device includes a collar coupled to the tapping element. The device includes a handle coupled to the collar.

10 Claims, 12 Drawing Sheets

DRINKING TUBE INSERTION DEVICE

TECHNICAL FIELD

This disclosure relates to a drinking tube insertion device.

BACKGROUND

Many different types of containers have tops or lids that are not adapted for use with drinking tubes (e.g., straws). The top of the container must be removed prior to inserting a drinking tube. While a drinking tube may be inserted into the container with the lid removed, often the size of the container opening is significantly larger than the diameter of the drinking tube. As a result, the drinking tube is not securely held in place and liquid inside the container may spill easily.

SUMMARY

An example implementation includes a device. The device includes a tapping element. The tapping element is threaded and includes a channel having an entry aperture and an exit aperture. The tapping element includes a point configured to pierce or puncture a container top. The device includes a collar coupled to the tapping element. The device includes a handle coupled to the collar.

The foregoing and other implementations can each optionally include one or more of the following features, alone or in combination. Some example implementations include all the following features in combination.

In one aspect, the tapping element is cylindrical.

In another aspect, the channel comprises a first portion that is oriented substantially parallel with the tapping element and a second portion oriented to form an angle with respect to the tapping element.

In another aspect, the angle is defined by a radius of curvature of the channel.

In another aspect, the exit aperture is located on a side of the tapping element.

In another aspect, the entry aperture is located at a top of the handle.

In another aspect, the channel is configured to receive a drinking tube.

In another aspect, the drinking tube is a straw.

In another aspect, the device includes a sealing element around the tapping element.

In another aspect, the handle is substantially perpendicular to the collar.

This Summary section is provided merely to introduce certain concepts and not to identify any key or essential features of the claimed subject matter. Other features of the inventive arrangements will be apparent from the accompanying drawings and from the following detailed description.

BRIEF DESCRIPTION OF THE DRAWINGS

The inventive arrangements are illustrated by way of example in the accompanying drawings. The drawings, however, should not be construed to be limiting of the inventive arrangements to only the particular implementations shown. Various aspects and advantages will become apparent upon review of the following detailed description and upon reference to the drawings.

FIG. 11 is a cross-sectional side view of the drinking tube insertion device with a drinking tube inserted there-through.

DETAILED DESCRIPTION

While the disclosure concludes with claims defining novel features, it is believed that the various features described within this disclosure will be better understood from a consideration of the description in conjunction with the drawings. The process(es), machine(s), manufacture(s) and any variations thereof described herein are provided for purposes of illustration. Specific structural and functional details described within this disclosure are not to be interpreted as limiting, but merely as a basis for the claims and as a representative basis for teaching one skilled in the art to variously employ the features described in virtually any appropriately detailed structure. Further, the terms and phrases used within this disclosure are not intended to be limiting, but rather to provide an understandable description of the features described.

For purposes of simplicity and clarity of illustration, elements shown in the figures have not necessarily been drawn to scale. For example, the dimensions of some of the elements may be exaggerated relative to other elements for clarity. Further, where considered appropriate, reference numbers are repeated among the figures to indicate corresponding, analogous, or like features. Further aspects of the inventive arrangements are described below with reference to the figures.

Figure 1:
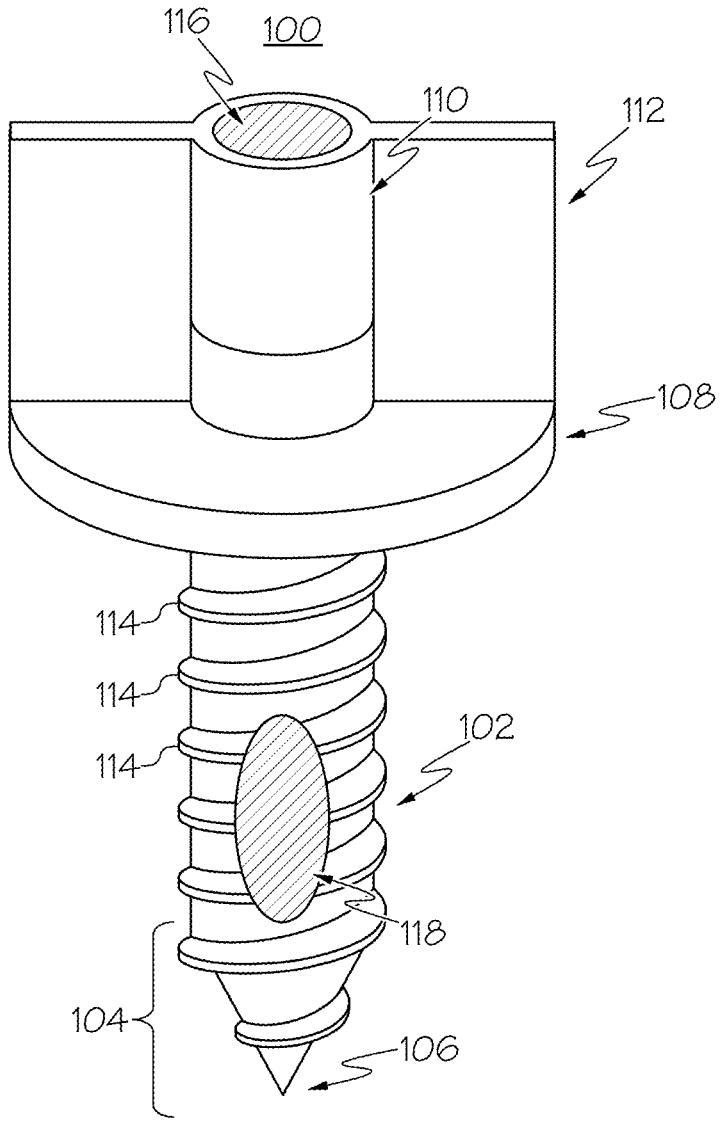
FIG. 1 is a perspective view of an example implementation of a drinking tube insertion device.

FIG. 1 illustrates a perspective view of an example implementation of drinking tube insertion device (device) 100. Device 100 is adapted to facilitate insertion of a drinking tube (e.g., a straw) into a container through a container top.

A container may be used or adapted to hold liquid that may be consumed by a human being. The liquid may be drawn from the container and consumed using a drinking tube. The container may have a container top. The term "container top" means a top portion of a container. The container top may be removable from the container, may not be resealable to the container once removed, may be resealable to the container once removed, or may not be removable from the container. In some cases, the container top may be integrated with the container. An example of a container top is a lid or other covering. The lid may be one that snaps onto the container, threads or screws onto the container, adheres to the container by way of an adhesive, or otherwise attaches or fastens to the container using another mechanism.

In the example of FIG. 1, device 100 has a tapping element 102. In general, tapping element is cylindrical. Tapping element 102 has a tapered portion 104 that forms a pointed end 106. Pointed end 106 is opposite from a collar 108. Device 100 also includes a stem 110 and a handle 112. Pointed end 106 may be inserted through a container lid. For example, pointed end 106 may be forced through a container lid to at least partially pierce the container lid. In the example, collar 108 is substantially perpendicular to handle 112 and tapping element 102.

Figure 11:
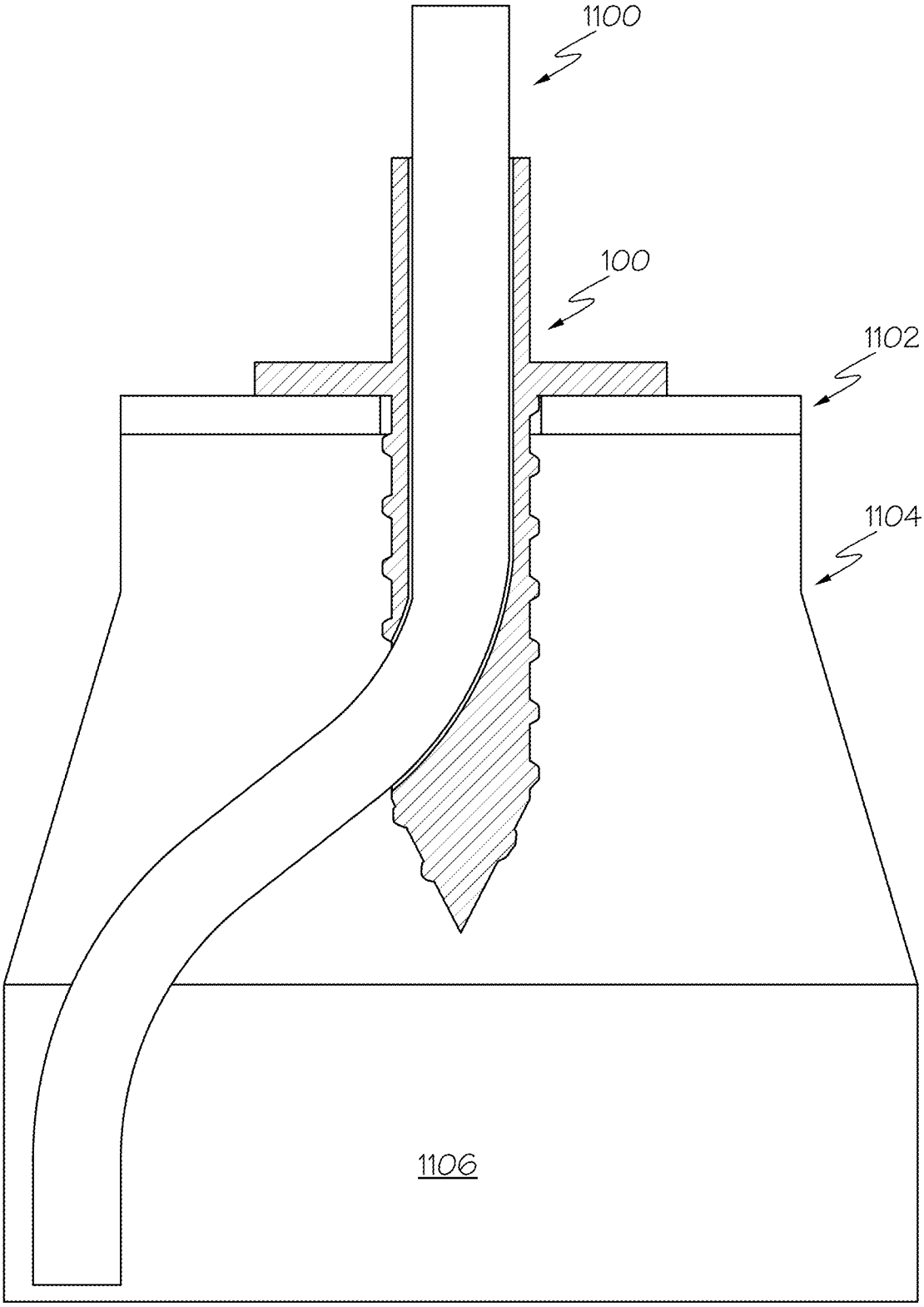

Tapping element 102 is threaded. The threads are formed on an outer surface of tapping element 102. Tapping element 102 may be pushed at least partially through a container top to engage threads 114 with the container top. Device 100 may be twisted using handle 112 so that threads 114 pull tapping element 102 through the container lid so that collar 108 contacts the container top. Twisting action of device 100 via handle 112 allows threads 114 to securely engage device 100 to a container top as shown in FIG. 11.

Device 100 includes an entry aperture 116 configured to receive a drinking tube. Device 100 includes an exit aperture 118 configured to allow an end of the drinking tube to exit device 100. Apertures 116 and 118 are at distal ends of a hollow tube or channel extending from entry aperture 116 through stem 110 and collar 108, down through tapping element 102 to exit aperture 118.

Figure 2:
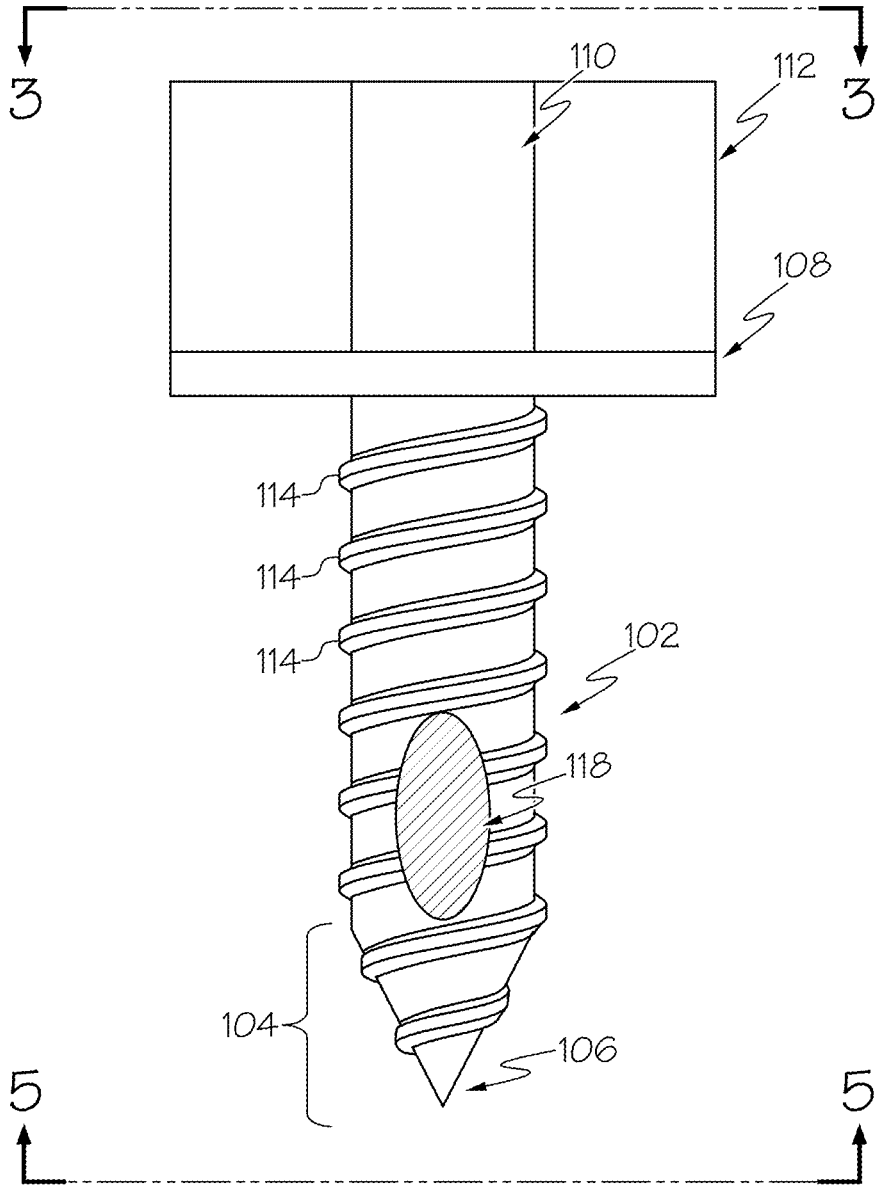
FIG. 2 is a side view of the drinking tube insertion device of FIG. 1.

FIG. 2 is a side view of device 100.

Figure 3:
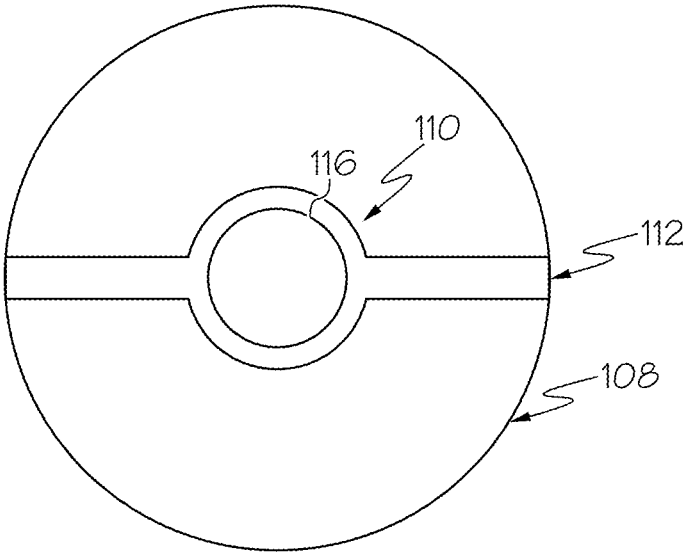
FIG. 3 is an overhead view of the drinking tube insertion device of FIG. 1 taken from the viewpoint of cut-line 3 of FIG. 2.

FIG. 3 is an overhead view of device 100 taken from the viewpoint of cut-line 3 of FIG. 2. In the example of FIG. 3, stem 110 is illustrated with entry aperture 116, handle 112, and collar 108.

Figure 4:
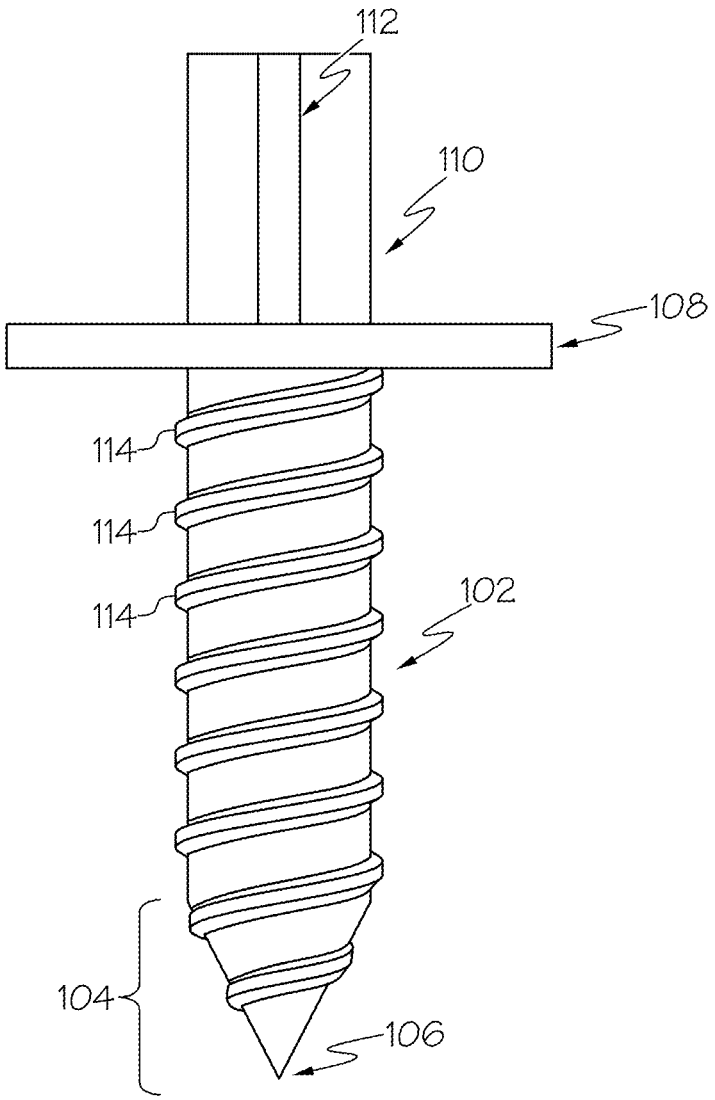
FIG. 4 is another side view of the drinking tube insertion device of FIG. 1.

FIG. 4 is another side view of device 100. In the example of FIG. 4, device 100 is rotated 90 degrees with respect to the viewing angle of FIG. 2. As such, exit aperture 118 is not visible.

Figure 5:
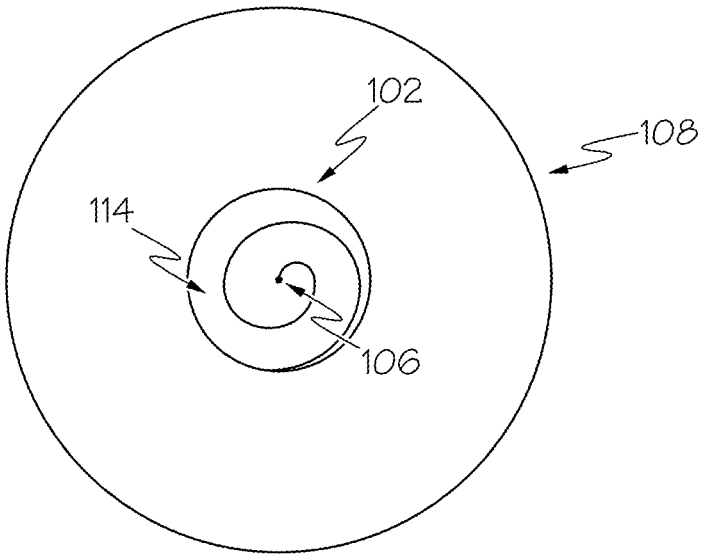
FIG. 5 is a view of the drinking tube insertion device of FIG. 1 taken from the viewpoint of cut-line 5 of FIG. 2.

FIG. 5 is a view of device 100 taken from the viewpoint of cut-line 5 of FIG. 2.

Figure 6:
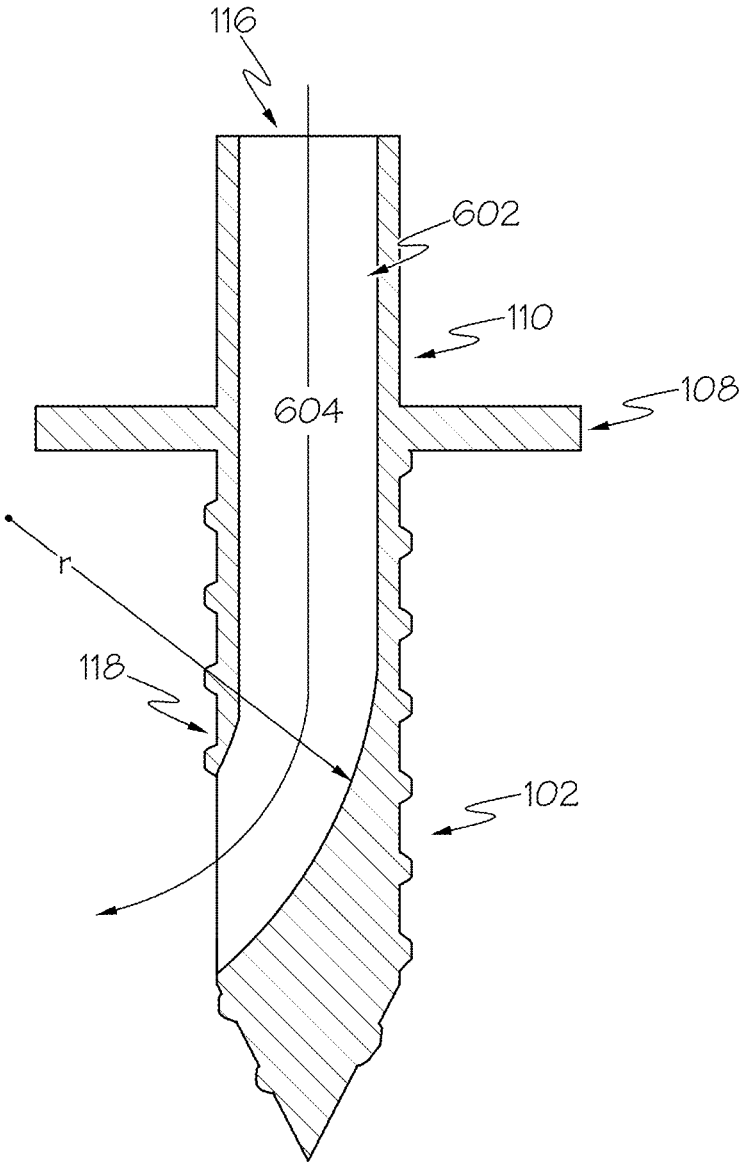
FIG. 6 is a cross-sectional side view of the drinking tube insertion device of FIG. 1.

FIG. 6 is a cross-sectional side view of device 100. In the example of FIG. 6, channel 602 is illustrated. As shown, channel 602 continues from entry aperture 116 to exit aperture 118. Channel 602 begins in an orientation that is aligned or parallel with the orientation of stem 110 and tapping element 102. Channel 602 includes a curve so that exit aperture 118 is located on a side or outer wall of tapping element 102. Channel 602 has a radius of curvature "r" that guides an end of a drinking tube inserted into entry aperture 116 through channel 602 along path 604 and out of exit aperture 118. The radius of curvature "r" may be large enough (e.g., non-zero) so that a drinking tube such as a straw made from plastic or paper may be inserted through channel 602 without catching so that the drinking tube exits catch-free from exit aperture 118. Channel 602 may be smooth inside so as to prevent any catching or snagging of the drinking tube when inserted through channel 602. The drinking tube may be made of a material that is capable of adapting to the shape of channel 602 (e.g., with flexibility and or moldability). That is, there is no dramatic or instant change in the angle of channel 602, but rather a smooth shift in angular direction along the non-zero radius. With device 100 having been inserted through a container top, one end of the drinking tube exits device 100 from exit aperture 118 and may be submerged into any fluid within the container.

Figure 7:
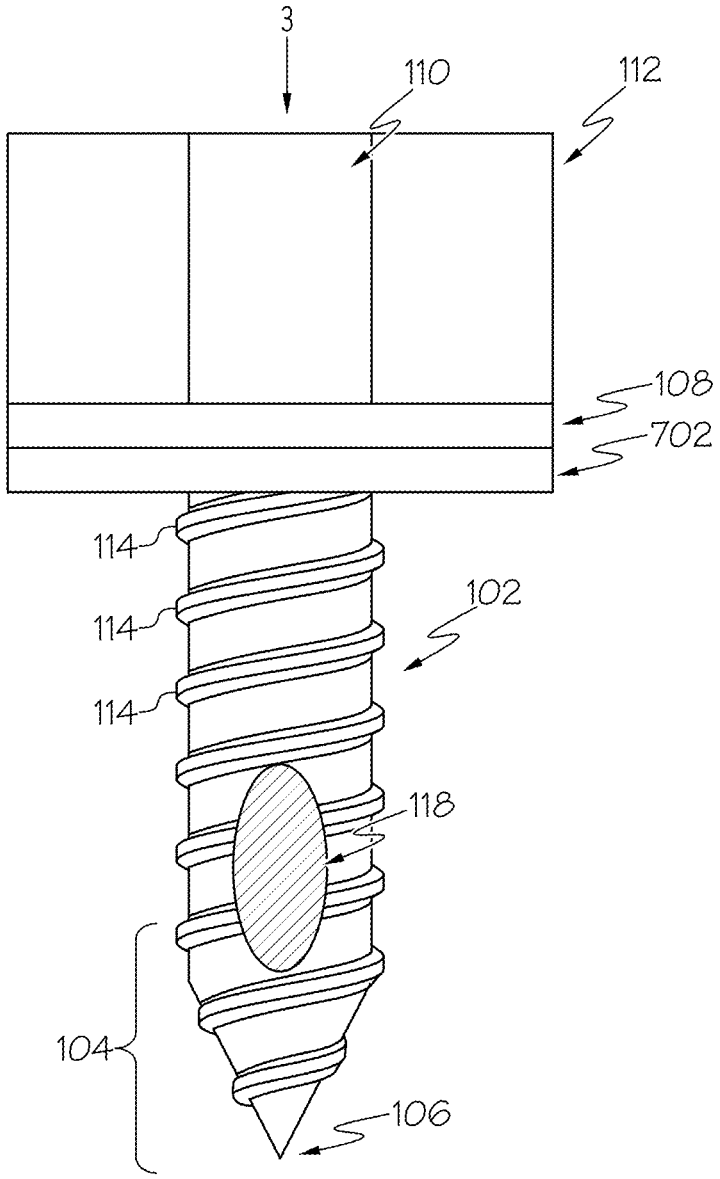
FIG. 7 is a side view of the drinking tube insertion device of FIG. 1 including a sealing element.

FIG. 7 is a side view of device 100. In the example of FIG. 7, a sealing element 702 is added directly beneath collar 108. Sealing element 702 facilitates a secure seal between device 100 and the container lid to prevent spillage of any liquid within the container. Liquid within the container is prevented from leaking out by sealing element 702.

In one aspect, sealing element 702 may be ring shaped and contact tapping element 102 with sufficient friction to prevent sealing element 702 from falling off. That is, sealing element 702 may be configured to contact tapping element 102 so as to prevent spillage of fluid from the container. In another aspect, sealing element 702 may be held in place using an adhesive between sealing element 702 and a bottom portion of collar 108.

Sealing element 702 facilitates spill resistant coupling between collar 108 and the container top. Sealing element 702 may be implemented as a sealer, a washer, or a gasket. In one or more example implementations, sealing element 702 may be formed of any of a variety of plastics, rubbers, cork, or other non-toxic material.

Figure 8:
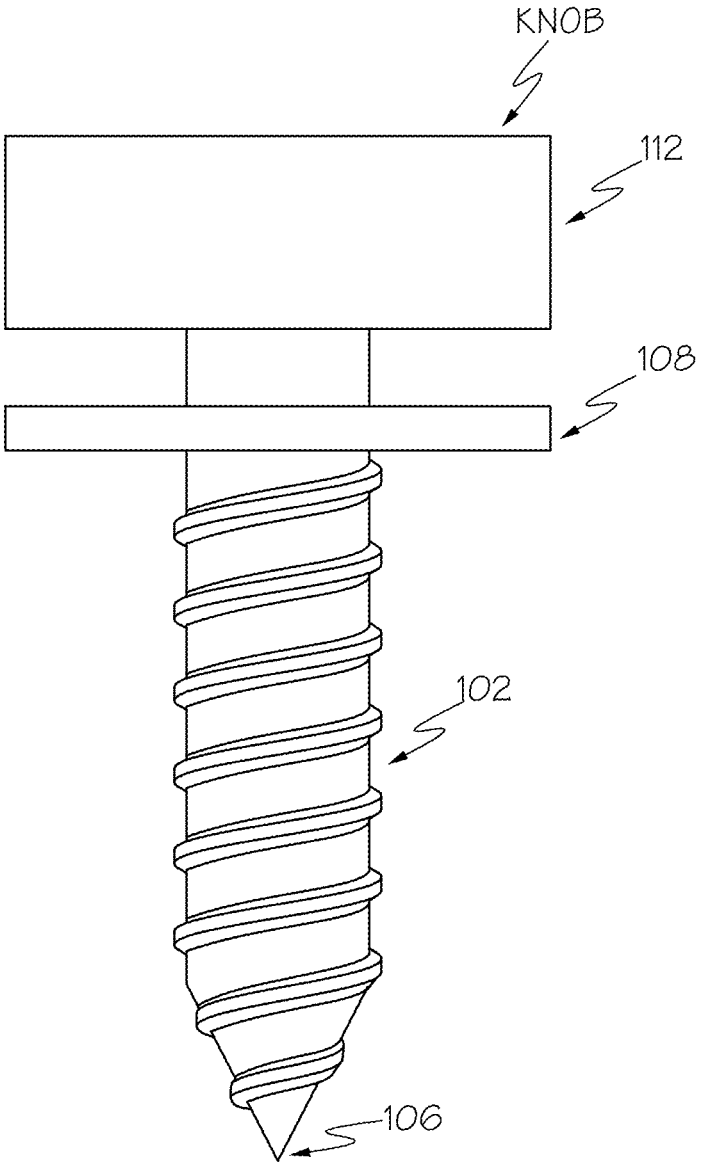
FIG. 8 is a side view of another example implementation of a drinking tube insertion device including an alternative handle.

FIG. 8 is a side view of another example implementation of device 100 in which handle 112 is formed as a round knob. A sealing element 702 may be included in the example of FIG. 8.

Figure 9:
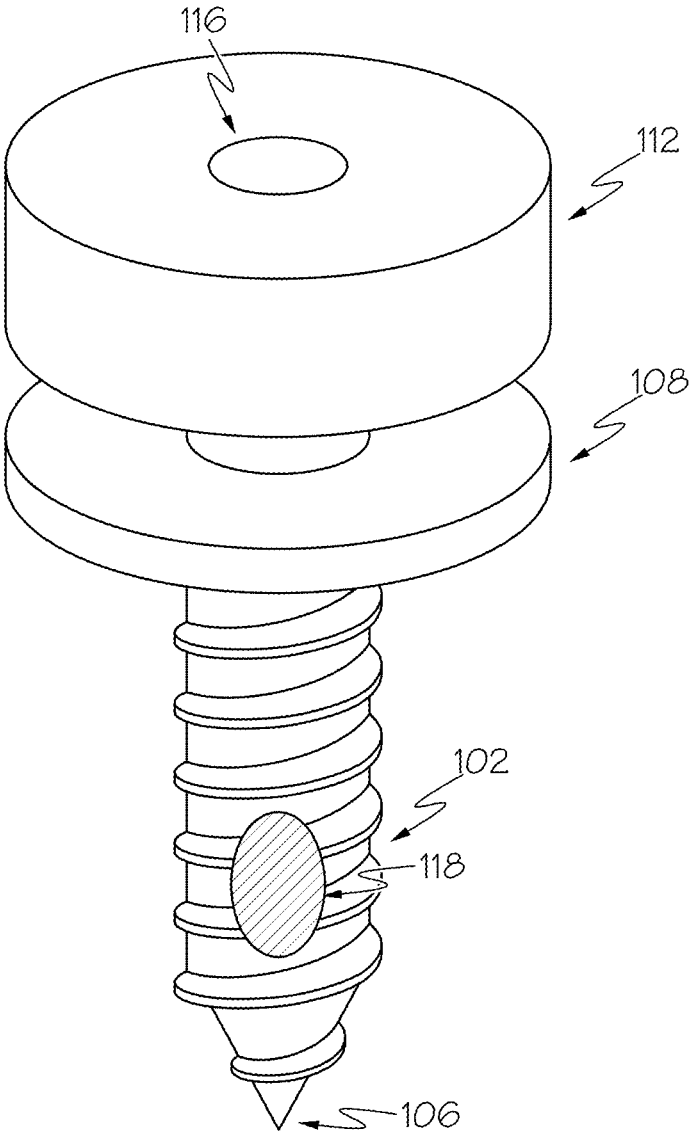
FIG. 9 is a perspective view of the example drinking tube insertion device of FIG. 8.

FIG. 9 is a perspective view of the example of FIG. 8 in which handle 112 is formed as a knob. A sealing element 702 may be included in the example of FIG. 9.

Figure 10:
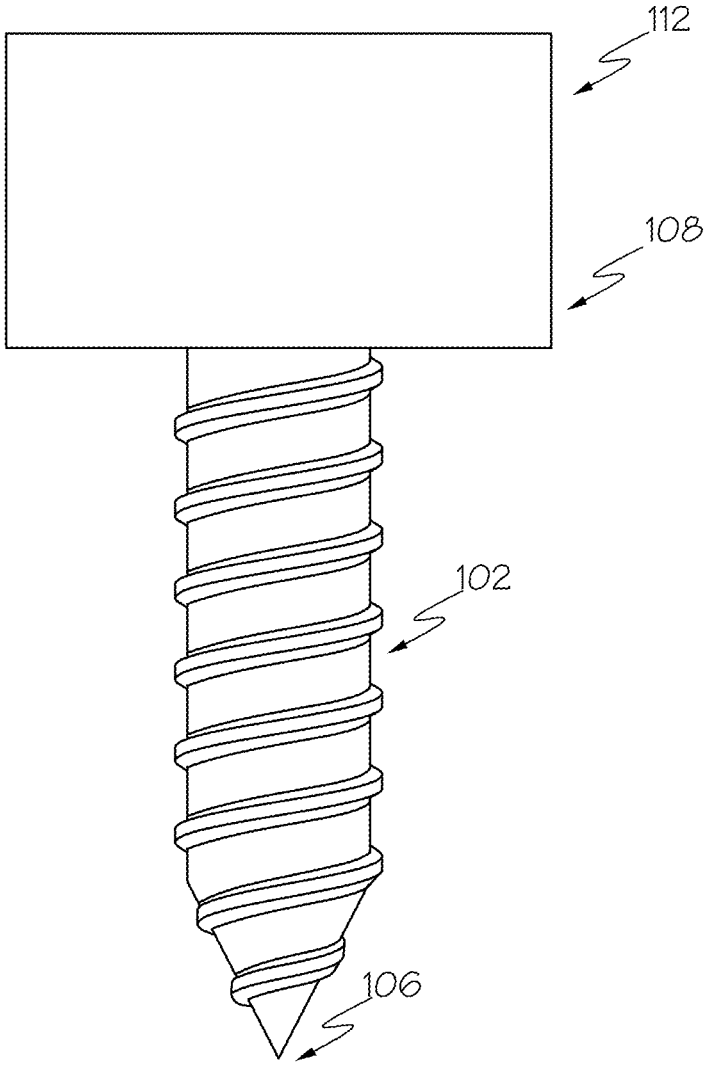
FIG. 10 is another example implementation of the drinking tube insertion device of FIG. 8.

FIG. 10 is another example implementation of device 100 with a knob type handle 112. In the example of FIG. 10, unlike those of FIGS. 8 and 9, handle 112 is continuous with collar 108. In this example, collar 108 and handle 112 may be formed as a single structure where collar 108 is effectively integrated within handle 112. A sealing element 702 may be included in the example of FIG. 10.

FIG. 11 is a cross-sectional side view of device 100 with a drinking tube 1100 inserted there-through. As pictured, device 100 has pierced container top 1102 of container 1104. Device 100 has been threaded to secure to container top 1102. The example of FIG. 11 illustrates a drinking tube 1100 inserted through device 100. In one or more embodiments, a conventional straw may be inserted into channel 602 and through device 100. A conventional straw, whether plastic, paper-based, or formed of another material, may be sufficiently flexible to bend along channel 602 upon insertion. Having been inserted, a person may draw liquid 1106 from container 1104 using drinking tube 1100.

Figure 12:
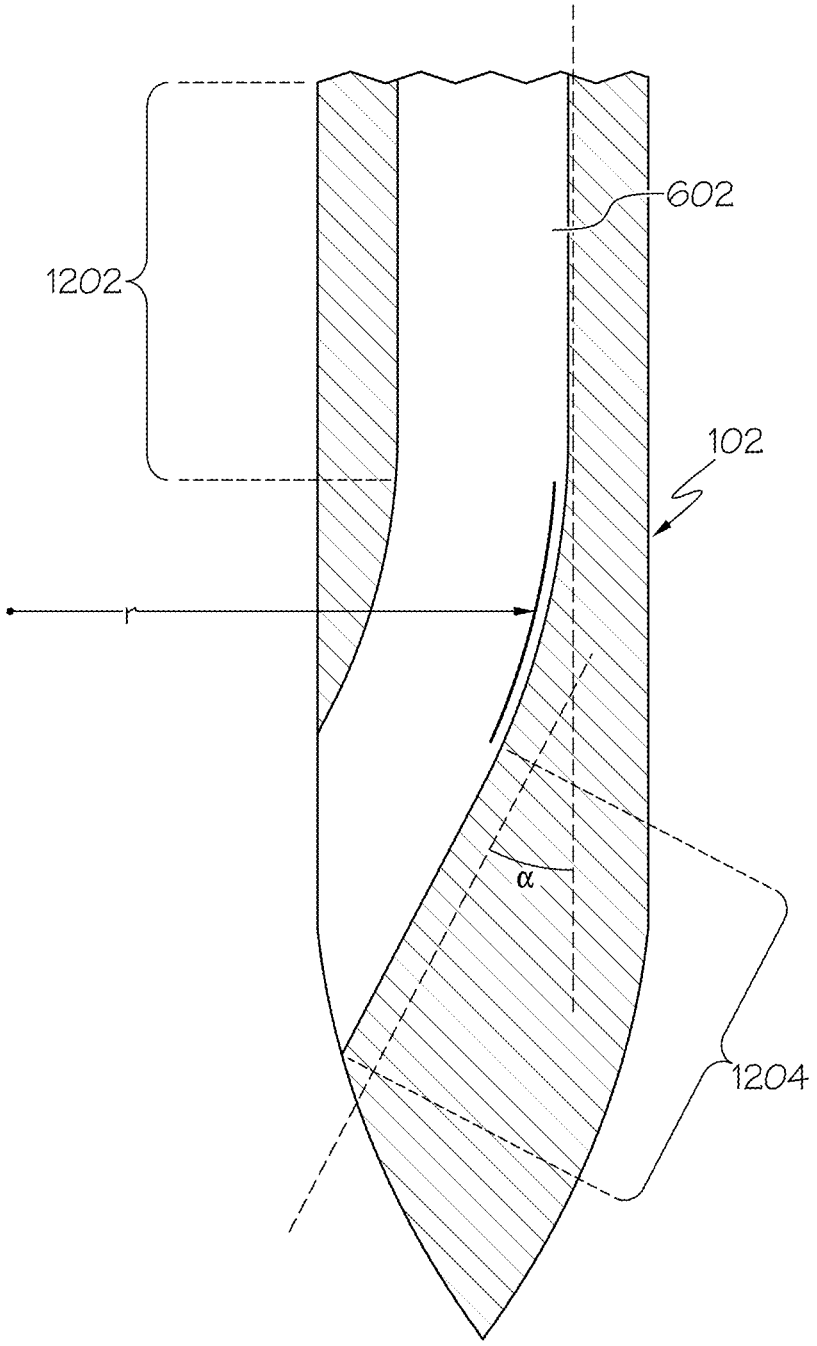
FIG. 12 is a cross-sectional side view of a portion of the tapping element of the drinking tube insertion device showing the channel.

FIG. 12 is a cross-sectional side view of a portion of tapping element 102 showing channel 602. For purposes of illustration, in the example of FIG. 12, the threads have been omitted. In the example, channel 602 is formed of a first portion 1202 that is oriented substantially parallel with the tapping element 102 and a second portion 1204 that is oriented to form an angle with respect to the tapping element. The angle $\alpha$ is defined by the radius of curvature r. In one aspect, the angle $\alpha$ is at or about 45 degrees. In one or more other examples, the angle $\alpha$ may be less then 45 degrees such as 40, 35, 30, 25, 20, 15, or 10 degrees. For example, the angle $\alpha$ may be any of a variety of angles between approximately 45 degrees and 10 degrees. Preferably, the angle $\alpha$ is such that the exit aperture 118 is along the size of tapping element 102 that is perpendicular or substantially perpendicular to collar 108 or other element similarly oriented (e.g., handle 112) and not within the tapered portion 104 (e.g., the exit aperture 118 is just above or above tapered portion 104).

It should be appreciated that the particular shapes of the handle portion described within this disclosure are provided for purposes of illustration and not limitation. Other handle shapes, whether integrated into collar 108 as described herein or not, may be used. Further, the radii of curvature may be altered so long as a drinking tube such a straw having some degree of flexibility may be inserted through the channel and still allow liquid to be drawn therethrough. For example, channel 118 may be shaped with a radius that avoids crimping of the drinking tube when inserted therethrough.

The example devices described herein may be manufactured using any of a variety of processes. In one or more examples, one or more of the elements or the entirety of device 100 may be formed of metal or alloy. In one or more other examples, one or more elements or the entirety of the device may be formed of any of a variety of plastics. The material selected is preferably of sufficient strength and/or rigidity to facilitate piercing of a container lid (e.g., of plastic or cardboard) and threading as described herein. The material of device 100 is preferably non-toxic. As noted, the optional sealing element may be made of other materials.

In one or more example implementations, the device may be formed of the various constituent components described herein that may be joined, adhered, or otherwise coupled together as an assembly formed of the constituent joined parts. In one or more other examples, the device may be formed or manufactured as a single unified part. For example, the device may be created by using a technology such as injection molding or 3-dimensional printing.

In one or more other example implementations, device 100 may be used with containers that already have holes or apertures for receiving a drinking tube. Device 100 may be inserted into the existing hole with the threads engaging to secure device 100 (e.g., the collar) to the container lid so that a drinking tube may be inserted to prevent spillage.

The terminology used within this disclosure is for the purpose of describing particular examples and implementations only and is not intended to be limiting. Notwithstanding, several definitions that apply throughout this disclosure are presented below.

As defined herein, the singular forms "a," "an," and "the" are intended to include the plural forms as well, unless the context clearly indicates otherwise.

As defined herein, the term "approximately" means nearly correct or exact, close in value or amount but not precise. For example, the term "approximately" may mean that the recited characteristic, parameter, or value is within a predetermined amount of the exact characteristic, parameter, or value.

As defined herein, the terms "at least one," "one or more," and "and/or," are open-ended expressions that are both conjunctive and disjunctive in operation unless explicitly stated otherwise. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B and C together.

As defined herein, the term "substantially" means that the recited characteristic, parameter, or value need not be achieved exactly, but that deviations or variations, including for example, tolerances, measurement error, measurement accuracy limitations, and other factors known to those of skill in the art, may occur in amounts that do not preclude the effect the characteristic was intended to provide.

The terms first, second, etc. may be used herein to describe various elements. These elements should not be limited by these terms, as these terms are only used to distinguish one element from another unless stated otherwise or the context clearly indicates otherwise.

What is claimed is:

1. A device, comprising:

a tapping element, wherein the tapping element is threaded and includes a channel having an entry aperture and an exit aperture;

wherein the tapping element includes a point configured to pierce a container top;

a collar coupled to the tapping element; and a handle coupled to the collar.

2. The device of claim 1, wherein the tapping element is cylindrical.

3. The device of claim 1, wherein the channel comprises a first portion that is oriented substantially parallel with the tapping element and a second portion oriented to form an angle with respect to the tapping element.

4. The device of claim 3, wherein the angle is defined by a radius of curvature of the channel.

5. The device of claim 1, wherein the exit aperture is located on a side of the tapping element.

6. The device of claim 1, wherein the entry aperture is located at a top of the handle.

7. The device of claim 1, wherein the channel is configured to receive a drinking tube.

8. The device of claim 7, wherein the drinking tube is a straw.

9. The device of claim 1, further comprising:

a sealing element around the tapping element.

10. The device of claim 1, wherein the handle is substantially perpendicular to the collar.

* * * * *